United States Patent [19]

Mühlen et al.

[11] 3,957,090

[45] May 18, 1976

[54] HYGROSCOPIC TRANSPORTING WEB

[75] Inventors: Peter Mühlen, Ulm, ULm; Karl Kassel, Arnegg, both of Germany

[73] Assignee: Mühlen Sohn, Blaustein u. Ulm, Germany

[22] Filed: Sept. 4, 1973

[21] Appl. No.: 393,792

[30] Foreign Application Priority Data

Sept. 5, 1972 Germany ..... 2243478

[52] U.S. Cl. ..... 139/409; 428/257

[51] Int. Cl.[2] ..... D03D 11/00

[58] Field of Search ..... 139/408–414; 161/90, 91; 198/193; 74/231; 428/225, 257

[56] References Cited

UNITED STATES PATENTS

| | | | |
|---|---|---|---|
| 2,862,283 | 12/1958 | Rasero | 139/408 |
| 2,864,409 | 12/1958 | Richter | 139/408 |
| 2,955,969 | 10/1960 | Runton | 161/90 |
| 3,197,021 | 7/1965 | Williams | 139/411 |
| 3,463,202 | 8/1969 | Wildi et al. | 139/408 |

*Primary Examiner*—William J. Van Balen
*Assistant Examiner*—James J. Bell
*Attorney, Agent, or Firm*—Michael J. Striker

[57] ABSTRACT

A web or belt, particularly for transporting moist corrugated cardboard, has an inner woven layer of high tensile strength, and two outer woven layers consisting of threads made of heat and abrasion resistant polyester and highly hygroscopic fibers, such as cellulose fibers. The warp threads of the outer layers pass over at least two weft threads staggered in longitudinal direction to avoid formation of a transverse groove across the web or belt.

1 Claim, 2 Drawing Figures

HYGROSCOPIC TRANSPORTING WEB

BACKGROUND OF THE INVENTION

The present invention relates to a hygroscopic web, and more particularly, to a special belt for machines producing corrugated cardboard. Belts for this type consist of one or several layers of great tensile strength which stretch little, and are covered at least on one side by outer layers.

Belts of this type have not only to transport corrugated cardboard, but also serve the purpose to absorb the moisture which is vaporized during drying, and is part of the glue adhering to the corrugated cardboard. Furthermore belts serving the above-explained purpose must be capable to distribute the pressure of the loading rollers of the apparatus uniformly to the corrugated cardboard which is to be adhesively connected, so that a sufficient and uniform adherence is obtained.

A belt or web of this type is described in the DGBM 1,964,682. In this transporting belt, the warp threads in the outer layers of the web consist of cotton threads, while the inner layer consist of a synthetic material. Originally, woven cotton belts were used, and it has also been proposed to use webs woven of synthetic material, or needled felts consisting of synthetic fibers, in order to overcome the disadvantages of cotton.

However, it has been found that in the webs of the prior art, the outer layers are worn off too quickly. Research by the inventors resulted in the recognition that the great wear is caused in the first place by low temperature resistance and abrasion resistance of cotton. Furthermore, the length of cotton webs is not constant and to the reduction of the strength of the cotton fibers, due to continuous effects of moisture, heat and tensile forces.

Belts according to the prior art consisting of synthetic yarns or of felt, consisting of synthetic fibers, have the disadvantage that they show undesirable properties due to surface smoothness and surface hardness, obtain a high electrostatic charge, and have unsufficient transverse tensile strength, transmit the pressure of the printing rollers only as line pressure and not as area pressure, and do not run as quietly as desired.

SUMMARY OF THE INVENTION

It is one object of the invention to provide a web or belt of the above-described type in such a manner that it has a long span of life, sufficient transporting force transmission for transporting the cardboard along, no electrostatic charge, uniform and constant distribution of the pressure of the pressure rollers to the cardboard, and high longitudinal and transverse stability, as well as quiet operation.

A preferred embodiment of the invention contains the following features:

The outer layers consist of a fiber yarn, particularly polyester with highly hygroscopic fibrous material preferably consisting of cellulose fibers of synthetic or natural origin;

in the outer layers, the warp threads are guided over at least two weft threads, staggered relative to each other in order to avoid the formation of transverse grooves on the surface web.

The softer outer layers are firmly woven together with the highly tensioned inner layer by tying threads, which can be carried out in one operation.

The weft threads inserted under high tension are tied in the respective layers. Preferably, it will be at least the outer warp threads that contain the hygroscopic material. Each outer warp thread has upper warp thread portions passing over at least two outer weft threads, the upper and lower warp thread portions of each outer warp thread being longitudinally staggered to the upper and lower warp thread portions of other outer warp threads, respectively, and each upper warp thread portion passing over outer weft threads under which a lower warp thread portion of an other outer warp thread passes, so that the outer weft threads are tied and the lower warp thread portions do not form straight grooves across the outer layer. Tying warp threads connect the inner and outer weft threads.

The polyester which is preferably used in the outer layers, is not only abrasion resistant but also heat resistant. As a result, the yarn fiber mixture has a far greater heat resistance and abrasion resistance than the cotton used in the webs of the prior art.

As compared with the known webs consisting of synthetic materials, or of needled felts consisting of synthetic material, the new web of the invention has a substantially improved moisture adsorption and retention, combined with the resulting anti-static properties, and with an excellent capacity of transporting paper or cardboard.

Due to staggering of the crossing points of the weft and warps in the outer layers, transverse grooves or ridges are avoided, while at the same time, a uniformly planar surface structure is obtained. As a result, the belts of the present invention run unusually quietly, the paper and cardboard transport by the belt is improved, while the uniform surface structure results in a uniform surface pressure on the cardboard. Since the inner layer which transmits the force is woven under high tension, and since the weft threads, which are inserted with the strongest pick, are tied to the layers which are woven together, an improved longitudinal and transverse stability of the web is obtained.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
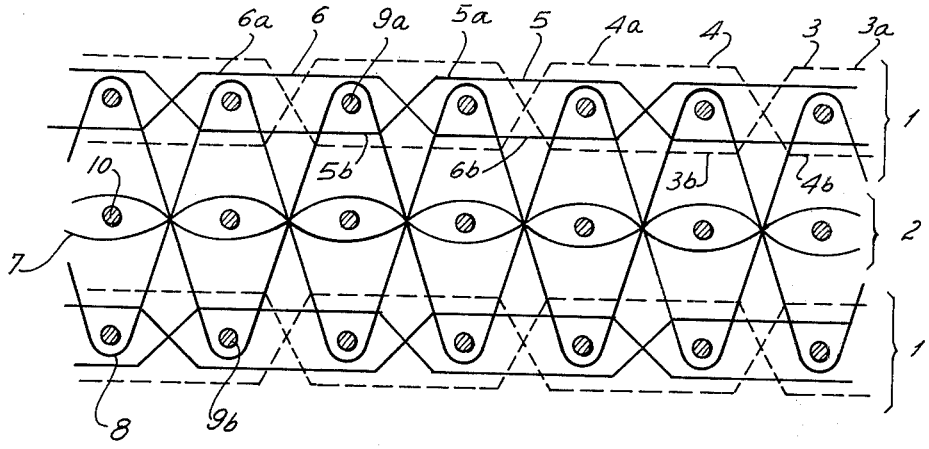
FIG. 1 is a vertical sectional view illustrating a woven web in accordance with the invention.

The illustrated web includes two outer layers 1, and an inner layer 2. Several warp threads 3, 4, 5, and 6, are provided in each of the outer layers, and it is possible to omit one of the outer layers. The inner layer 2 which transmits the tensile forces, has warp threads 7 passing over weft threads 10 of the inner layer 2.

Weft threads **9*a* and 9*b* of the outer layers 1 are connected with each other by tieing threads 8 which also pass between the weft threads 10 of the inner layer. Each warp thread of an outer layer 1 has upper portions 3*a* and 4*a*, for example, and lower portion 3*b*** and 4*b*, which pass respectively, over two weft threads 9*a* or under two weft threads 9*a*. The upper warp thread portion 4*a* passes over the same two weft threads 9*a* under which the lower warp yarn portion 3*b* passes. The outer and inner warp thread portions 3*a*, 3*b*, 4*a*, 4*b*, 5*a*, 5*b*, 6*a*, 6*b* are staggered to each other in longitudinal direction, so that the lower warp thread portions 3*b*, 4*b* of different warp threads 3 to 6 are not aligned across the fabric and do not form transverse grooves or ridges.

Figure 2:
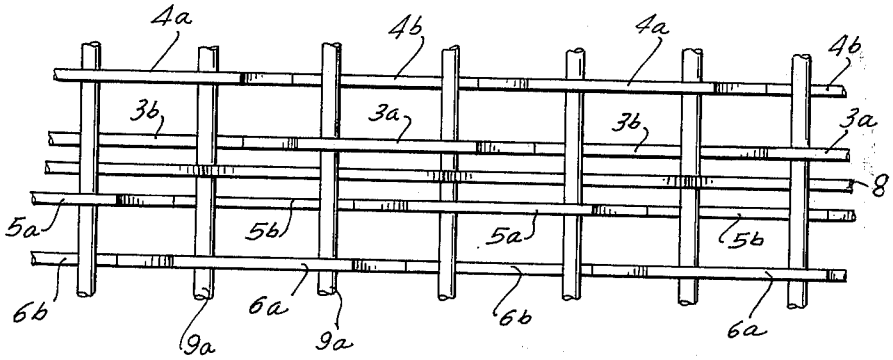
FIG. 2 is a schematic plan view of the web shown in FIG. 1.

FIG. 2 is a schematic top view, and shows the upper portions 4*a* alternating with the lower warp thread portions 4*b* which are shown in broken double lines. The hatched portions of the weft threads 9*a* indicate the parts passing over the lower portions of the warp threads 3 to 6.

The above described web according to the invention is advantageously woven on eccentric loom, or on a dobby loom.

It will be understood that each of the elements described above, or two or more together, may also find a useful application in other types of a web or belt differing from the types described above.

While the invention has been illustrated and described as embodied in a hygroscopic transporting belt having a woven outer layer including yarns consisting of polyester and cellulose fibers, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed as new and desired to be protected by Letters Patent is set forth in the appended claims.

We claim:

1. Hygroscopic transporting web for transporting moist materials, comprising at least one inner layer consisting of a high strength, stretch resistant woven fabric including inner warp threads and inner weft threads; at least one outer layer located on one side of said inner layer and including outer warp threads and outer weft threads, at least said outer warp threads containing a highly hygroscopic fibrous material, each outer warp thread having upper ward thread portions passing over at least two outer weft threads, and lower warp thread portions passing under at least two other outer weft threads, said upper and lower warp thread portions of each outer warp thread being longitudinally staggered relative to the upper and lower warp thread portions of other outer warp threads, respectively, and each upper warp thread portion passing over outer weft threads under which a lower warp thread portion of an other outer warp thread passes so that said lower warp thread portions do not form straight grooves across said outer layer; and tying warp threads interwoven between said outer and inner weft threads so as to tie said inner and outer layers together.

* * * * *